US007125107B2

(12) United States Patent
Satake et al.

(10) Patent No.: US 7,125,107 B2
(45) Date of Patent: Oct. 24, 2006

(54) METHOD FOR DRIVING PIEZOELECTRIC INK JET HEAD

(75) Inventors: Kenichi Satake, Kyoto (JP); Hisamitsu Sakai, Kagoshima (JP)

(73) Assignee: Kyocera Corporation, Kyoto (JP)

( * ) Notice: Subject to any disclaimer, the term of this patent is extended or adjusted under 35 U.S.C. 154(b) by 240 days.

(21) Appl. No.: 10/880,364

(22) Filed: Jun. 28, 2004

(65) Prior Publication Data

US 2005/0024400 A1 Feb. 3, 2005

(30) Foreign Application Priority Data

Jun. 30, 2003 (JP) ..... 2003-187956

(51) Int. Cl.
*B41J 2/45* (2006.01)

(52) U.S. Cl. ..... 347/68; 347/71

(58) Field of Classification Search ..... 347/54, 347/68–72, 9

See application file for complete search history.

(56) References Cited

U.S. PATENT DOCUMENTS

| | | | | |
|---|---|---|---|---|
| 5,266,964 | A | 11/1993 | Takahashi et al. | |
| 5,402,469 | A | 3/1995 | Hopper et al. | |
| 6,419,348 | B1 * | 7/2002 | Kojima et al. | 347/72 |
| 6,431,691 | B1 | 8/2002 | Tanikawa et al. | |
| 6,575,565 | B1 | 6/2003 | Isono et al. | |
| 2003/0103118 | A1 * | 6/2003 | Watanabe et al. | 347/71 |

FOREIGN PATENT DOCUMENTS

| | | |
|---|---|---|
| EP | 1 403 052 | 3/2004 |
| GB | 2 392 550 | 3/2004 |
| JP | 04-371845 | 12/1992 |
| JP | 08-118630 | 5/1996 |
| JP | 08-118663 | 5/1996 |
| JP | 2000-141647 | 5/2000 |
| JP | 2001-077438 | 3/2001 |

* cited by examiner

*Primary Examiner*—Lamson Nguyen
*Assistant Examiner*—Lisa M. Solomon
(74) *Attorney, Agent, or Firm*—Hogan & Hartson LLP

(57) ABSTRACT

The present invention is directed to a method for driving a piezoelectric ink jet head comprising a piezoelectric actuator AC that includes two piezoelectric ceramic layers 7*a*, 7*b* having such a size that covers the plurality of pressure chambers 2, wherein an electric field of opposite sense to the polarizing direction is applied to the second piezoelectric ceramic layer 7*b* by using the common electrodes 8*a*, 8*b* and, (1) for the pressure chambers 2 from which the ink is discharged, an electric field of the same sense as the polarizing direction of the layer is applied to the first piezoelectric ceramic layer 7*a* by using the individual electrode 10 and the first common electrode 8*a*, thereby causing the region of the piezoelectric actuator AC to deflect toward the pressure chamber 2, while (2) for the pressure chambers 2 from which the ink should not be discharged, an electric field of the opposite sense to the polarizing direction is applied to the first piezoelectric ceramic layer 7*a* by using the electrodes 10, 8*a*, thereby to maintain the region of the piezoelectric actuator AC in the initial state, so as to discharge an ink droplet selectively through the nozzle 3 that communicates with the pressure chamber 2 described in (1) and form a dot.

5 Claims, 10 Drawing Sheets

METHOD FOR DRIVING PIEZOELECTRIC INK JET HEAD

TECHNICAL FIELD

The present invention relates to a method for driving a piezoelectric ink jet head and, more particularly, to a method for driving a piezoelectric ink jet head that can be preferably used in printer, copier, facsimile, and a composite machine which combines some of the former.

BACKGROUND OF THE INVENTION

For a piezoelectric ink jet head that uses the electrostrictive effect of a piezoelectric element as the drive power source and is employed in an on-demand type ink jet printer or the like, one having such a constitution is employed as a plurality of pressure chambers to be filled with an ink are disposed on one side of a plate-shaped substrate in the direction of surface thereof, each of the pressure chambers being provided with a nozzle for discharging the ink that communicates therewith, and piezoelectric actuator stacked on the side of the substrate whereon the pressure chambers are disposed.

The piezoelectric actuator is generally constituted from an electrically conductive oscillator plate of such a size that covers the plurality of pressure chambers, a piezoelectric ceramic layer that are separately formed in correspondence to the pressure chambers, and a plurality of individual electrodes which are formed separately in correspondence to the pressure chambers, being stacked in this order. The electrically conductive oscillator plate, together with the individual electrodes, sandwiches the piezoelectric ceramic layer so as to serve also as a common electrode for applying an electric field to the piezoelectric ceramic layer.

In the piezoelectric ink jet head described above, when an electric field of the same sense as the polarizing direction of the piezoelectric ceramic layer is applied between at least one of the plurality of individual electrodes that correspond to the pressure chambers and the oscillator plate, the piezoelectric ceramic layer that is sandwiched by the individual electrode and the oscillator plate contracts in the direction of the surface. Since the piezoelectric ceramic layer is fastened onto the oscillator plate, the region of the piezoelectric actuator to which the electric field is applied deflects so as to protrude toward the pressure chamber in accordance to the contraction, while the deflection compresses the ink in the pressure chamber, so that an ink droplet is discharged through the nozzle for printing.

Recently, in order to provide for the ever-decreasing nozzle pitch that corresponds to the resolution of printing in the ink jet printers which has been becoming higher, a piezoelectric ink jet head has been commercialized that employs a piezoelectric ceramic layer of such a size that covers a plurality of pressure chambers, instead of a plurality of piezoelectric ceramic layer which are formed separately corresponding to the pressure chambers.

In this piezoelectric ink jet head, when an electric field of the same sense as the polarizing direction of the piezoelectric ceramic layer is applied between at least one of the plurality of individual electrodes that correspond to the pressure chambers and the oscillator plate, a particular region of the piezoelectric ceramic layer that is sandwiched by the individual electrode and the oscillator plate contracts in the direction of the surface like individual piezoelectric ceramic layer that are formed separately. In accordance to the contraction, the region of the piezoelectric actuator to which the electric field is applied deflects so as to protrude toward the pressure chamber, while the deflection compresses the ink in the pressure chamber, so that an ink droplet is discharged through the nozzle for printing.

A so-called bimorph piezoelectric ink jet head is also proposed that comprises two piezoelectric ceramic layers stacked one on another.

In the bimorph piezoelectric ink jet head, at the same time the first piezoelectric ceramic layer is caused to contract in the direction of the surface, a second piezoelectric ceramic layer is caused to expand in the direction of the surface by applying an electric field of opposite sense to the polarizing direction, thereby making it possible to achieve a satisfactory deflection of the piezoelectric actuator toward the pressure chamber, with the electric field of lower intensity than in the conventional piezoelectric ink jet head that has only one piezoelectric ceramic layer (called the unimorph type piezoelectric ink jet head in contrast to the bimorph type).

The piezoelectric ink jet head is described in detail in, for example, Japanese Unexamined Patent Publication Nos. H04-371845-A2 (1992), H08-118630-A2 (1996), H08-118663-A2 (1996), 2000-141647-A2 (2000) and 2001-77438-A2 (2001).

However, since the bimorph piezoelectric ink jet heads described in these publications all have two piezoelectric ceramic layers formed separately in correspondence to the pressure chambers, there has been such a problem that it cannot provide for the smaller nozzle pitch that corresponds to the higher resolution of printing in the ink jet printers.

In order to provide for the smaller nozzle pitch, the first and the second piezoelectric ceramic layers must have dimensions that cover the plurality of pressure chambers. But this leads to a problem of complicated structure of the piezoelectric actuator.

When two piezoelectric ceramic layers that have dimensions that cover the plurality of pressure chambers are used while maintaining the electrode structure in the piezoelectric ink jet head described in the patent publication mentioned above, it may be conceived to use a piezoelectric actuator AC having either the structure shown in FIG. 10 or the structure shown in FIG. 11.

Among these, the piezoelectric actuator AC shown in FIG. 10 is constituted from first individual electrodes 90*a* formed separately corresponding to pressure chambers 92, a first piezoelectric ceramic layer 97*a* having such a size that covers a plurality of pressure chambers, second individual electrodes 90*b* formed separately corresponding to the pressure chambers 92, a second piezoelectric ceramic layer 97*b* having such a size that covers a plurality of pressure chambers, a common electrode 98*a* having a size that covers a plurality of pressure chambers 92 and a protective layer 99 having such a size that covers a plurality of pressure chambers for protecting the common electrode 98*a* from the ink, that are stacked on the substrate 91 in this order from a position far from the substrate 91.

The piezoelectric actuator AC is manufactured by printing an electrically conductive paste to form the second individual electrodes 90*b* on one side of a green sheet of piezoelectric material that would make the second piezoelectric ceramic layer 97*b*, stacking a green sheet of piezoelectric material that would make the first piezoelectric ceramic layer 97*a* thereon, firing the stack so as to bake the three layers described above, printing an electrically conductive paste to form the first individual electrodes 90*a* on one side of the stack, and printing an electrically conductive paste to form the common electrode 98*a* on the other side of the stack.

However, the second individual electrodes 90*b* undergo changes in the position within the plane and in shape as the green sheet of piezoelectric material expands and then shrinks significantly during the firing process; moreover, the changes cannot be observed from the outside after firing.

Thus there is such a problem that it is difficult to align the individual electrodes 90*a*, 90*b* with the pressure chambers 92 when printing the electrically conductive paste to form the first individual electrodes 90*a* in alignment and when bonding the piezoelectric actuator AC onto the substrate 1.

In addition, in order to connect lead wires to the second individual electrodes 90*b*, it is necessary to form the lead-out wire by printing at the same time as the printing of the electrically conductive paste to form the second individual electrodes 90*b*, or to form via holes in the first piezoelectric ceramic layer 97*a* and provide the wiring.

In the case of the former, however, there is such a problem that a space for printing the lead-out wire is required which makes it impossible to provide for the smaller nozzle pitch.

In the case of the latter, there is such a problem that the additional process for forming the via holes or connecting the wire makes the manufacturing process complex and also makes the structure of the piezoelectric actuator AC more complex.

The piezoelectric actuator AC shown in FIG. 11 is constituted from the first individual electrodes 90*a* formed separately corresponding to pressure chambers 92, the first piezoelectric ceramic layer 97*a* having such a size that covers the plurality of pressure chambers, the common electrode 98*b* having such a size that covers the plurality of pressure chambers, the second piezoelectric ceramic layer 97*b* having such a size that covers the plurality of pressure chambers 92, second individual electrodes 90*c* formed separately corresponding to pressure chambers 92 and the protective layer 99 for protecting the second individual electrodes 90*c* from the ink, that are stacked on the substrate 91 in this order from a position far from the substrate 91.

The piezoelectric actuator AC can be manufactured similarly to that described previously.

The first and second individual electrodes 90*a*, 90*c* can be printed and formed after firing the green sheet of piezoelectric material, and therefore can be aligned easily with each either and with the pressure chamber 92.

In order to connect leads to the second individual electrodes 90*c*, it is necessary to form the lead-out wire by printing at the same time as the printing of the electrically conductive paste to form the second individual electrodes 90*c*, or to form via holes in the first and second piezoelectric ceramic layer 97*a*, 97*b* and provide the wiring.

In the case of the former, there is such a problem that a space for printing the lead-out wire is required which makes it impossible to provide for the smaller nozzle pitch, similarly to that described previously.

In the case of the latter, there is such a problem that the additional process for forming the via holes or connecting the wire makes the manufacturing process complex and also makes the structure of the piezoelectric actuator AC more complex.

There is also such a problem that the positions where the via holes are formed in the piezoelectric ceramic layers 97*a*, 97*b* undergo unpredictable displacement in the direction of plane in the firing process, thus making the alignment difficult.

SUMMARY OF THE INVENTION

An object of the present invention is to provide a drive method that can make electrodes for applying electric field to both piezoelectric ceramic layers and the lead wires connecting the electrodes simpler than those of the prior art, in a bimorph type piezoelectric ink jet head comprising a piezoelectric actuator that uses piezoelectric ceramic layers having such a size that covers a plurality of pressure chambers for both of the two piezoelectric ceramic layers.

In order to achieve the object described above, the present inventors constituted a bimorph type piezoelectric ink jet head by stacking on a substrate a first piezoelectric ceramic layer of transverse vibration mode, a first common electrode, a second piezoelectric ceramic layer of transverse vibration mode and a second common electrode, all having such a size that covers a plurality of pressure chambers, in this order from a position far from the substrate, and forming a plurality of individual electrodes formed thereon in correspondence to the pressure chambers.

With this piezoelectric actuator, since the individual electrodes can be printed and formed after firing the green sheet of piezoelectric material, it is easy to align them with the pressure chambers and it is easy to wire since the electrodes are exposed on the piezoelectric actuator as described above.

In addition, it is not necessary to align the first and second common electrodes and, since the wiring can be connected at any one point outside of the region where the pressure chambers are to be formed, the structure can be simplified and wiring can be made easily.

The present inventors completed the present invention through investigation on the polarity and timing of applying the electric field to both piezoelectric ceramic layers by means of the electrodes in order to achieve satisfactory deflection of the piezoelectric actuator in a particular region thereof by causing the region of the first piezoelectric ceramic layer that corresponds to one or more pressure chambers to contract in the direction of surface and, in synchronization therewith, and causing the region of the second piezoelectric ceramic layer to expand in the direction of surface in the piezoelectric actuator described above.

The present invention is a method for driving a piezoelectric ink jet head that comprises a plate-shaped substrate having a plurality of recesses that would become pressure chambers to be filled with an ink being formed on one side of the substrate in the direction of substrate surface, with a nozzle that discharges the ink filling the pressure chamber as ink droplet to communicate with each recess, and a piezoelectric actuator having a first piezoelectric ceramic layer of transverse vibration mode, a first common electrode, a second piezoelectric ceramic layer of transverse vibration mode and a second common electrode, all having such a size that covers the plurality of pressure chambers, are stacked in this order from a position far from the substrate on the surface of the substrate where the recesses are formed, and having a plurality of individual electrodes formed thereon in correspondence to the pressure chambers is disposed on the first piezoelectric ceramic layer, characterized that the piezoelectric actuator is put in the initial state by removing the electric fields applied to both of the piezoelectric ceramic layers in the period of standby, while an electric field of opposite sense to the polarizing direction is applied to the second piezoelectric ceramic layer by using the first and second common electrodes when forming a dot, and in synchronization thereof, (1) for the pressure chambers from which ink droplet should be discharged through the nozzle, an electric field of the same sense to the polarizing direction of the layer is applied to a region of the first piezoelectric ceramic layer disposed between the individual electrode corresponding to the pressure chamber and the first common electrode by using the electrodes, thereby causing the corresponding region of the piezoelectric actuator to deflect and protrude toward the pressure chamber, while (2) for the pressure chambers from which the ink droplet should not be discharged through the nozzle, an electric field of the opposite sense to the polarizing direction of the layer is applied to a region of the first piezoelectric ceramic layer disposed between the individual electrode corresponding to the pressure chamber and the first common electrode by using the electrodes, thereby maintaining the corresponding region of the piezoelectric actuator in the initial state, so as to discharge an ink droplet selectively through the nozzle that communicates with the pressure chamber described in (1) and form a dot.

With the drive method of the present invention described above, in the pressure chamber mentioned in (1), satisfactory deflection of the piezoelectric actuator toward the pressure chamber in a particular region thereof can be achieved with a lower voltage than used in the conventional unimorph type through the function of bimorph type, by causing the region of the first piezoelectric ceramic layer that is sandwiched between the individual electrode that corresponds to the particular pressure chamber and the common electrode to contract in the direction of surface and causing the region of the second piezoelectric ceramic layer to expand in the direction of surface.

In the pressure chamber mentioned in (2), the region of the first piezoelectric ceramic layer sandwiched between the individual electrode that corresponds to the pressure chamber and the first common electrode is caused to expand in the direction of surface together with the second piezoelectric ceramic layer, thereby to maintain the region of the piezoelectric actuator in the initial state in which the electric fields are removed from both the piezoelectric ceramic layers.

Thus an ink droplet can be selectively discharged from the nozzle that communicates with the pressure chamber mentioned in (1) thereby forming a dot.

For the drive method of the present invention described above, it is preferable that the first and second piezoelectric ceramic layers are made of the same piezoelectric material with the same thickness and, when forming a dot, potential difference $V_1$ of electric field that is applied to a region of the first piezoelectric ceramic layer disposed between the individual electrode corresponding to the pressure chamber from which the ink should be discharged through the nozzle and the first common electrode by using the electrodes, potential difference $V_2$ of electric field that is applied to a region of the first piezoelectric ceramic layer disposed between the individual electrode corresponding to the pressure chamber from which the ink should not be discharged through the nozzle and the first common electrode by using the electrodes, and potential difference $V_3$ of electric field applied to the second piezoelectric ceramic layer are set to satisfy the equation $\frac{1}{2}V_1=V_2=V_3$.

This makes it possible to achieve more satisfactory deflection of the region of the piezoelectric actuator for the pressure chamber mentioned in (1), and maintain the region of the piezoelectric actuator in a state same as the initial state in which the electric fields are removed from both piezoelectric ceramic layers for the pressure chamber mentioned in (2).

With the drive method of the present invention described above, it is preferable that the pulse width from the start of applying the electric field to the removal thereof is set in a range from 1 to $\frac{5}{4}$ times the intrinsic period of vibration of the volumetric velocity of the ink in the nozzle, for the electric field of the opposite sense to the polarizing direction applied to the second piezoelectric ceramic layer when forming a dot, the electric field of the same sense as the polarizing direction applied to the region of the first piezoelectric ceramic layer that corresponds to the pressure chamber from which the ink should be discharged through the nozzle in synchronization with the electric field mentioned above, and the electric field of the opposite sense to the polarizing direction of the layer applied to the region of the first piezoelectric ceramic layer from which the ink should not be discharged through the nozzle in synchronization with the electric fields mentioned above.

This makes it possible to improve the efficiency of discharging ink.

The present inventors also studied other methods for driving a piezoelectric ink jet head provided with the piezoelectric actuator described above, and accordingly completed the present invention.

The present invention is a method for driving a piezoelectric ink jet head that comprises a plate-shaped substrate having a plurality of recesses that would become pressure chambers to be filled with an ink being formed on one side of the substrate in the direction of substrate surface, with a nozzle that discharges the ink which fills the pressure chamber as ink droplet to communicate with each recess, and a piezoelectric actuator having a first piezoelectric ceramic layer of transverse vibration mode, a first common electrode, a second piezoelectric ceramic layer of transverse vibration mode and a second common electrode, all having such a size that covers the plurality of pressure chambers, are stacked in this order from a position far from the substrate on the surface of the substrate where the recesses are formed, and having the plurality of individual electrodes formed thereon in correspondence to the pressure chambers is disposed on the first piezoelectric ceramic layer, characterized that in the standby period, an electric field of the same sense as the polarizing direction of the layer is applied to the entire region of the first piezoelectric ceramic layer disposed between all of the individual electrodes and the first common electrode by using the electrodes, and an electric field of the opposite sense to the polarizing direction of the layer having substantially the same intensity as that applied to the first piezoelectric ceramic layer is applied to the second piezoelectric ceramic layer by using the first common electrode and the second common electrode, thereby causing the region of the piezoelectric actuator that corresponds to all the pressure chambers to deflect so as to protrude toward the pressure chamber and, when forming a dot, the electric field applied to the second piezoelectric ceramic layer is once removed and, after a predetermined period of time, the same electric field as that of the standby period is applied again and the following processes are carried out so as to discharge an ink droplet selectively through the nozzle that communicates with the pressure chamber described in (i) and form a dot:

(i) for the pressure chamber from which an ink droplet should be discharged through the nozzle, in synchronization with the removal of the electric field applied to the second piezoelectric ceramic layer, the electric field applied to a region of the first piezoelectric ceramic layer disposed between the individual electrode that corresponds to the pressure chamber and the first common electrode by means of the electrodes is also removed so as to put the region of the piezoelectric actuator in the initial state, then in synchronization with the re-application of the electric field to the second piezoelectric ceramic layer, an electric field of the same sense to the polarizing direction of the layer having an intensity about twice that of the standby period is applied to the region of the first piezoelectric ceramic layer so as to cause the region of the piezoelectric actuator to deflect and protrude toward the pressure chamber more than during the standby period and, after a predetermined period of time, intensity of the electric field applied to the region is changed to the level of standby period so as to return the corresponding region of the piezoelectric actuator to the standby state, and (ii) for the pressure chamber from which an ink droplet should not be discharged through the nozzle, in synchronization with the removal of the electric field applied to the second piezoelectric ceramic layer, an electric field of the same sense as the polarizing direction of the layer having an intensity about twice that of standby period is applied to a region of the first piezoelectric ceramic layer disposed between the individual electrode that corresponds to the pressure chamber and the first common electrode by means of the electrodes, so as to maintain the amount of deflection of the region of the piezoelectric actuator toward the pressure chamber at the same level as that of the standby period and, thereafter, in synchronization with the re-application of the electric field to the second piezoelectric ceramic layer, intensity of the electric field applied to the region is changed to the level of the standby period so as to return the region of the piezoelectric actuator to the standby state.

According to the drive method of the present invention described above, during the standby period, the region of the first piezoelectric ceramic layer disposed between all of the individual electrodes and the first common electrode is caused to contract in the direction of the surface and the second piezoelectric ceramic layer is caused to expand in the direction of the surface, thereby making it possible to achieve satisfactory deflection of the piezoelectric actuator over the entire region thereof toward the pressure chamber with a lower voltage than that used in the conventional unimorph type by the function of bimorph type described previously.

When forming a dot, while the expansion of the second piezoelectric ceramic layer in the direction of the surface is once canceled and then caused to expand again in the direction of the surface, and then for the pressure chamber mentioned in (i), in synchronization with the cancellation of the expansion of the second piezoelectric ceramic layer, the contraction of the region of the first piezoelectric ceramic layer disposed between the individual electrode that corresponds to the pressure chamber and the common electrode is canceled so as to put the corresponding region of the piezoelectric actuator in the initial state, thereby pulling the ink meniscus in the nozzle toward the pressure chamber.

Then, in synchronization with the re-expansion of the second piezoelectric ceramic layer, the region of the first piezoelectric ceramic layer is caused to contract more than during the standby period and, so that the corresponding region of the piezoelectric actuator deflects so as to protrude toward the pressure chamber more than during the standby period, thereby to discharge the ink through the nozzle. Since the body of ink protruding from the nozzle tip looks like a cylinder, the protruding portion of ink is generally called the ink column. Then after a predetermined period of time, the amount of contraction of the region is changed to the level of the standby period so as to return the corresponding region of the piezoelectric actuator to the standby state, thereby pulling the main body of ink into the pressure chamber and separate the ink column, thereby forming an ink droplet.

Then, for the pressure chamber mentioned in (ii), in synchronization with the cancellation of expansion of the second piezoelectric ceramic layer, the region of the first piezoelectric ceramic layer disposed between the individual electrode that corresponds to the pressure chamber and the common electrode is caused to contract more than during the standby period, so as to maintain the amount of contraction of the region toward the pressure chamber at the level of standby period. Then the amount of contraction of the region is changed to the level of the standby period in synchronization with the re-expansion of the second piezoelectric ceramic layer, so as to return the corresponding region of the piezoelectric actuator to the state of standby, thereby preventing the ink from being discharged through the nozzle.

Thus, an ink droplet can be selectively discharged through the nozzle that communicates with the pressure chamber described in (i) so as to form a dot.

According to the drive method of the present invention described above, it is preferable that all the pulse widths are set in a range from ½ to ¾ times the intrinsic period of vibration of the volumetric velocity of the ink in the nozzle, for the pulse width from removal of the electric field applied to the second piezoelectric ceramic layer when forming a dot to the re-application thereof, pulse width from removal of the electric field applied to the region of the first piezoelectric ceramic layer that corresponds to the pressure chamber from which the ink should be discharged through the nozzle in synchronization with the above to the time when application of an electric field of intensity about twice that of the standby period is started, and pulse width from the time when the electric field of intensity about twice that of standby period is applied to the region of the first piezoelectric ceramic layer that corresponds to the pressure chamber from which the ink should not be discharged through the nozzle in synchronization with the above to the time when the intensity of the electric field is changed to the level of standby period.

With this constitution, efficiency of discharging the ink can be improved.

DESCRIPTION OF PREFERRED EMBODIMENTS

Figure 1:
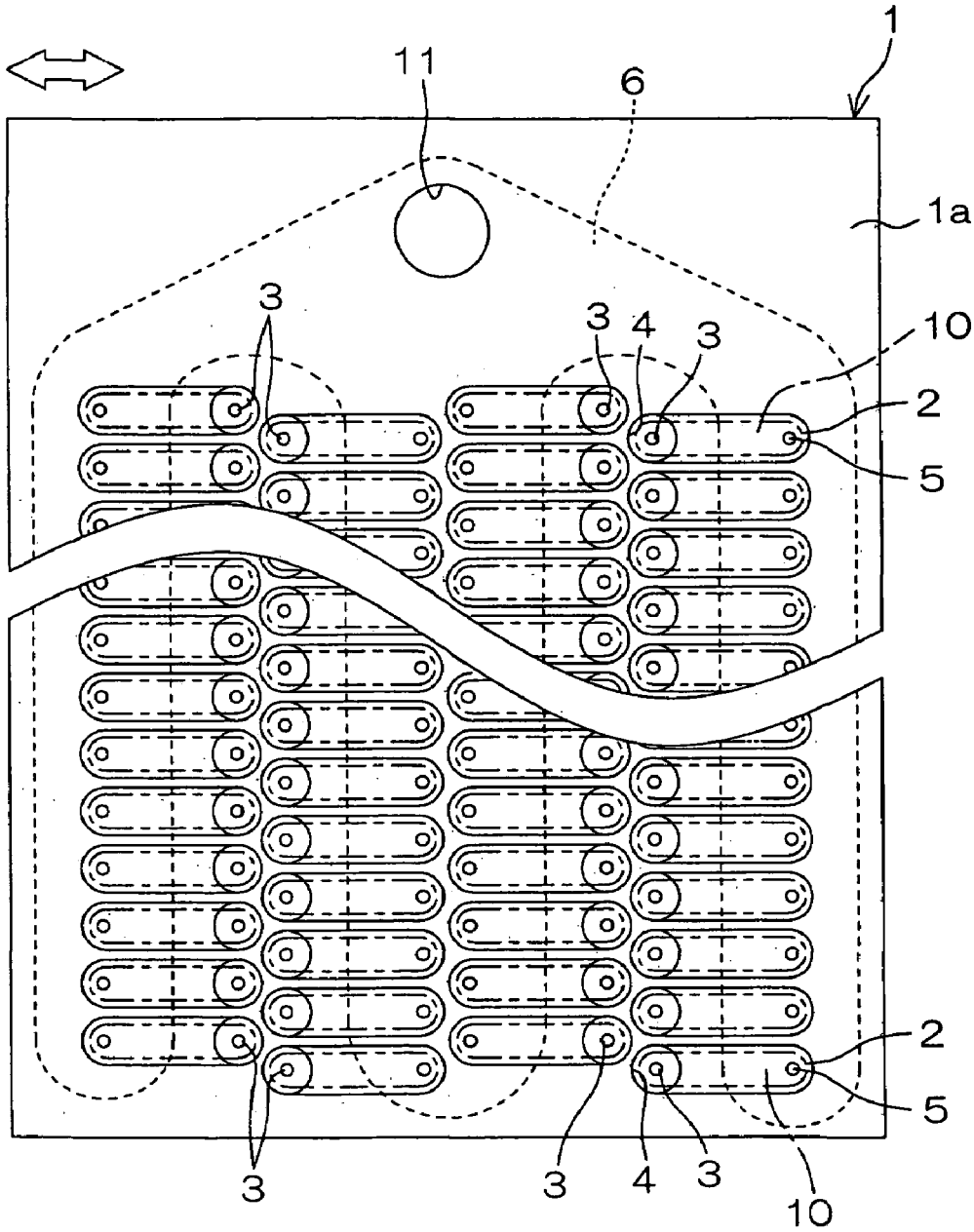
FIG. 1 is a plan view showing an example of piezoelectric ink jet head used in the drive method of the present invention, in a state before a piezoelectric actuator is installed.

FIG. 1 is a plan view showing an example of piezoelectric ink jet head for implementing the drive method of the present invention, in a state before a piezoelectric actuator is installed.

The piezoelectric ink jet head of the example shown in FIG. 1 has a plurality of dot forming sections, each comprising a pressure chamber 2 and a nozzle 3 that communicates therewith, disposed on a substrate 1.

Figure 2:
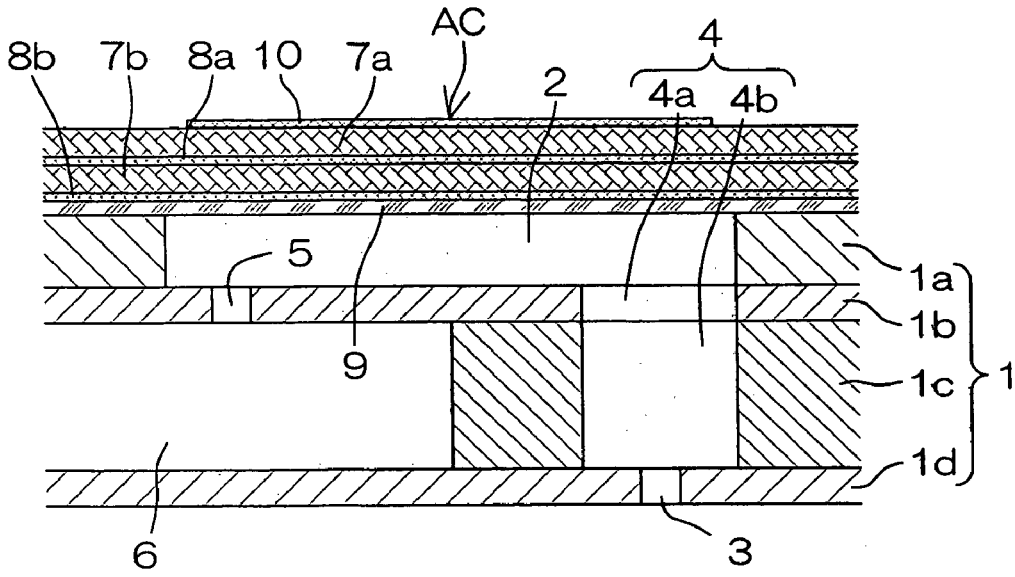
FIG. 2 is an enlarged sectional view along line A—A of FIG. 3 showing a dot forming section in the piezoelectric ink jet head of the example shown in FIG. 1 with the piezoelectric actuator installed thereon.
Figure 3:
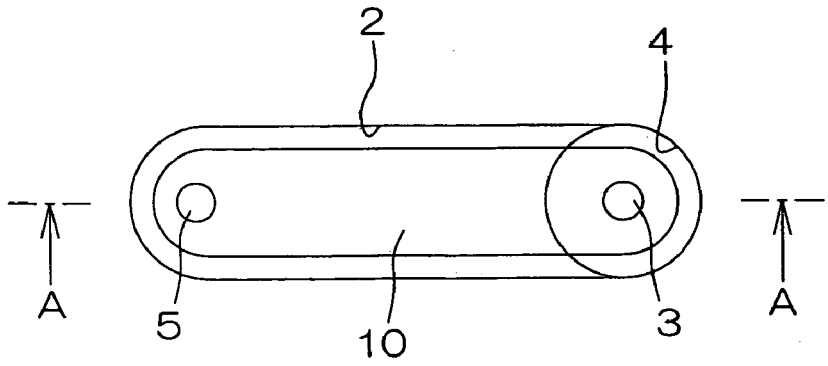
FIG. 3 is a perspective view showing the relationship between components constituting one dot forming section.

FIG. 2 is an enlarged sectional view of a dot forming section in the piezoelectric ink jet head of the example described above with the piezoelectric actuator installed thereon. FIG. 3 is a perspective view showing the relationship between components that constitute the dot forming section being stacked one on another.

The nozzles 3 of the dot forming sections are disposed in plurality along the principal scan direction indicated by white arrow mark in FIG. 1. The dot forming sections of the example shown are disposed in four rows, while the dot forming sections are arranged at pitches of 90 dpi in the same row, thus achieving a resolution of 360 dpi in the piezoelectric ink jet head as a whole.

Each of the dot forming sections comprises the pressure chamber 2 that is formed on the upper surface of the substrate 1 as shown in FIG. 2 and has a planar configuration of a rectangular mid portion with semicircular portions connected to both ends thereof (refer to FIG. 3) and a nozzle 3 formed at a position that corresponds to the center of the semicircle at one end of the pressure chamber 2 on the lower surface of the substrate 1, the pressure chamber 2 and the nozzle 3 being connected with a nozzle passage 4 that has circular cross section of the same diameter as that of the semicircle located at the end, while the pressure chamber 2 is connected to a common feed path 6 (indicated with dashed line in FIG. 1) that is formed so as to connect the dot forming sections in the substrate 1, via a feed port 5 formed at a position that corresponds to the center of the semicircle at the other end of the pressure chamber 2.

In the example shown, the components described above have such a constitution as a first substrate 1*a* whereon the pressure chambers 2 are formed, a second substrate 1*b* whereon an upper portion 4*a* of the nozzle passage 4 and the feed port 5 are formed, a third substrate 1*c* whereon a lower portion 4*b* of the nozzle passage 4 and the common feed path 6 are formed, and a fourth substrate 1*d* whereon the nozzles 3 are formed, are stacked in this order so as to form an integral structure.

The first substrate 1*a* and the second substrate 1*b* have through holes 11 formed therein so as to constitute a joint for connecting the common feed path 6 formed on the third substrate 1*c* and the piping that runs from an ink cartridge which is not shown in the drawing, on the upper surface of the substrate 1 as shown in FIG. 1.

The substrates 1*a* through 1*d* are made of a resin or a metal in plates of predetermined thickness having the through holes formed by etching or the like using photolithography process.

On the upper surface of the substrate 1, a first piezoelectric ceramic layer 7*a* of transverse vibration mode, a first common electrode 8*a*, a second piezoelectric ceramic layer 7*b* of transverse vibration mode, a second common electrode 8*b* and a protective layer that protects the common electrode 8*b* from the ink, all having a size that covers the plurality of pressure chambers 2, being stacked in this order from the upper position in FIG. 2 far from the substrate 1, while a plurality of individual electrodes 10 are formed separately on the first piezoelectric ceramic layer 7*a* in correspondence to the pressure chambers 2, thereby constituting the piezoelectric actuator AC.

The piezoelectric actuator AC can be manufactured by using a green sheet of piezoelectric material that becomes a thin plate of piezoelectric material when fired, similarly to the prior art.

Specifically, for example, the piezoelectric actuator AC can be manufactured by printing an electrically conductive paste to form the first common electrode 8*a* on one side of a green sheet of piezoelectric material that would make the second piezoelectric ceramic layer 7*b*, placing a green sheet of piezoelectric material that would make the first piezoelectric ceramic layer 7*a* thereon, firing the laminate, printing an electrically conductive paste to form the individual electrodes 10 on one side of the laminate, printing an electrically conductive paste to form the second common electrode 8*b* on the other side and forming the protective layer 9.

Piezoelectric material used in forming the first and second piezoelectric ceramic layers 7*a*, 7*b* of the piezoelectric actuator AC described above may be lead zirconate titanate (PZT), or PZT-based piezoelectric material made by adding one or more oxide of a metal such as lanthanum, barium, niobium, zinc, nickel or manganese to PZT, such as PLZT, for example, may be used. Lead magnesium niobate (PMN), lead nickel niobate (PNN), lead zinc niobate, lead manganese niobate, lead antimony stannate, lead titanate or barium titanate may be included as a major component. The green sheet of piezoelectric material includes compound that would make the some of the piezoelectric material described above when fired.

In order to cause the piezoelectric ceramic layers 7*a*, 7*b* to function in transverse vibration mode, the piezoelectric material is controlled to polarize in the direction of thickness. For this purpose, a known polarizing method may be employed such as high-temperature polling, normal temperature polling, alternate electric field superposition or electric field cooling process. The piezoelectric ceramic layers 7*a*, 7*b* may be subjected to aging treatment after polling. A piezoelectric ceramic layer of transverse vibration mode contracts in the direction of the surface when subjected to an electric field of the same sense as the direction of polarization and expands in the direction of the surface when subjected to an electric field of the opposite sense to the direction of polarization.

For the electrically conductive paste used to form the first common electrode 8*a*, a paste that includes powder of a metal that has high electrical conductivity such as gold, silver, platinum, copper or aluminum may be used. The first common electrode 8*a* is formed by firing a layer of such an electrically conductive paste together with the green sheet of piezoelectric material described above so that the metal powder included in the paste is sintered, melted or integrated.

The second common electrode 8*b* and the individual electrode 10 can be formed by printing an electrically conductive paste similar to that described above as described previously. However, these electrodes may also be formed in the form of a foil, plating film, vacuum vapor deposition film or the like of the metal that has high electrical conductivity such as those described above.

With the piezoelectric actuator AC described above, since the individual electrodes 10 can be formed after firing the green sheet of piezoelectric material, it is easy to align with the pressure chambers 2 and it is easy to wire since the individual electrodes 10 are exposed on the piezoelectric actuator AC as described above.

In addition, it is not necessary to align the first and second common electrodes 8*a*, 8*b* and, since the wiring can be connected at any one point outside of the region where the pressure chambers 2 are to be formed, the structure can be simplified and wiring can be made easily.

The piezoelectric ink jet head is obtained by securing the piezoelectric actuator AC on the substrate 1 by means of adhesive or the like.

<Method I for Driving the Piezoelectric Ink Jet Head>

The first method of the present invention for driving the piezoelectric ink jet head to form a dot will be described below with reference to FIG. 4A through FIG. 4C and FIG. 5A through FIG. 5C.

Figure 5A:
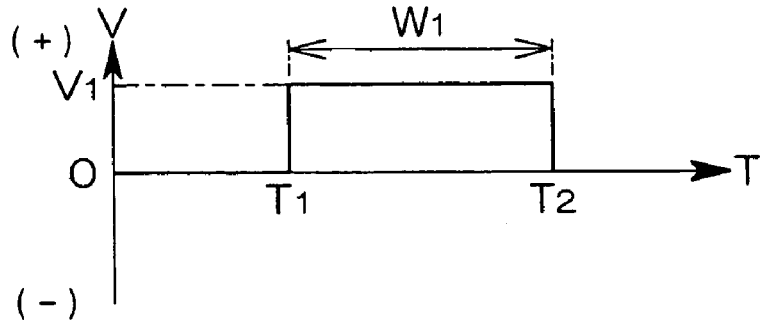
FIG. 5A through FIG. 5C are graphs showing the pulse waveform of the electric field applied to both piezoelectric ceramic layers in the drive method described above.
Figure 5B:
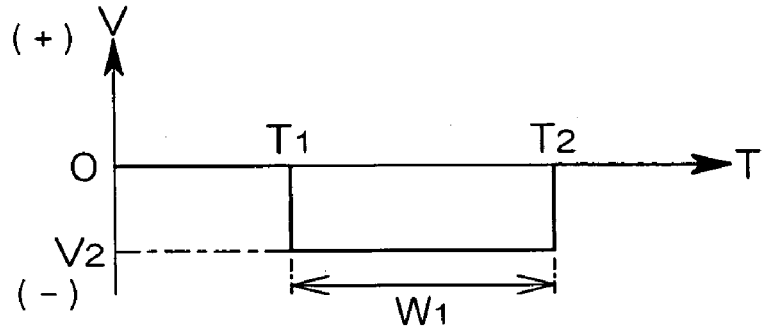
Figure 5C:
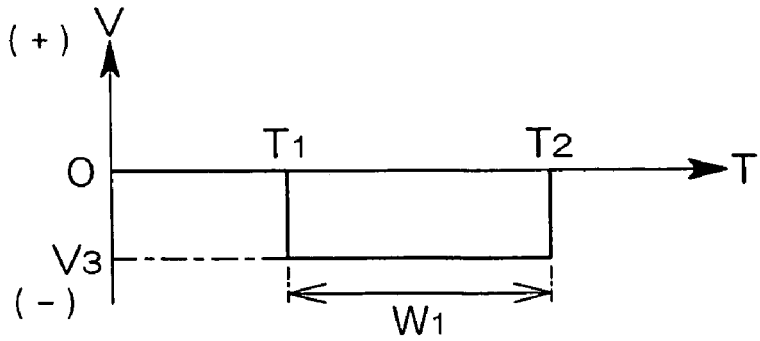

FIG. 5A through FIG. 5C are graphs showing an example of pulse waveform of the electric field applied to the piezoelectric ceramic layer 7*a*, 7*b* in the first drive method.

FIG. 5A shows the pulse waveform of the electric field applied to a region of the first piezoelectric ceramic layer 7*a* disposed between the individual electrode 10 that corresponds to the pressure chamber 2 and the first common electrode 8*a* by using both electrodes for the pressure chamber 2 mentioned in (1) from which an ink droplet should be discharged through the nozzle 3. FIG. 5B shows the pulse waveform of the electric field applied to the region of the first piezoelectric ceramic layer 7*a* described above for the pressure chamber 2 mentioned in (2) from which an ink droplet should not be discharged through the nozzle 3. FIG. 5C shows the pulse waveform of the electric field applied to the second piezoelectric ceramic layer 7*b* by using the first and second common electrodes 8*a*, 8*b*.

In these figures, the same sense of electric field as the direction of polarization of the piezoelectric ceramic layers 7*a*, 7*b* is denoted as (+) and opposite sense of electric field is denoted as (−). The common electrode 8*a* is grounded.

With the drive method described above, the electric fields applied to the first and second piezoelectric ceramic layers 7*a*, 7*b* are both removed (potential difference 0 V) so as to put the piezoelectric actuator AC in the initial state during the standby period (from point 0 to $T_1$ and period after $T_2$ in FIG. 5A through FIG. 5C) (refer to FIG. 4).

In this state, the ink supplied from an ink cartridge fills a piping of the ink cartridge, the through hole 11, the common feed passage 6, the feed port 5, the pressure chamber 2 and the nozzle passage 4, and is stationary while forming an ink meniscus in the nozzle 3.

White arrow mark shown in the piezoelectric ceramic layers 7*a*, 7*b* in the figure indicates the direction of polarization of the layers 7*a*, 7*b*. Although the figure shows the same direction of polarization for the layers 7*a*, 7*b*, the directions may be opposite to each other.

Figure 4A:
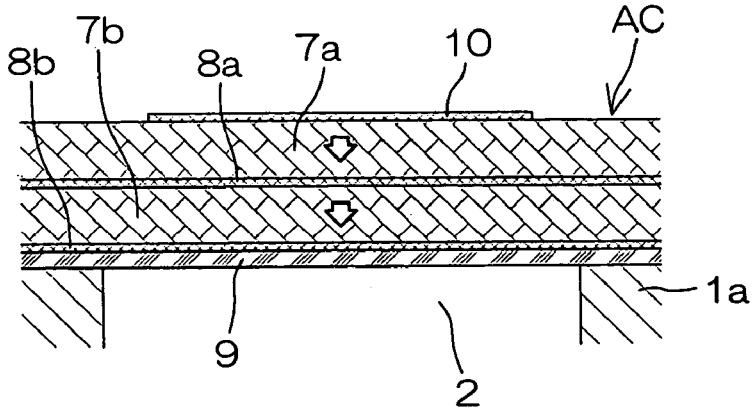
FIG. 4A through FIG. 4C are sectional views explanatory of the relation between the sense of electric field applied to the first and second piezoelectric ceramic layers and the polarizing direction of both piezoelectric ceramic layers when driving the piezoelectric ink jet head of the example described above by the first drive method of the present invention.
Figure 4B:
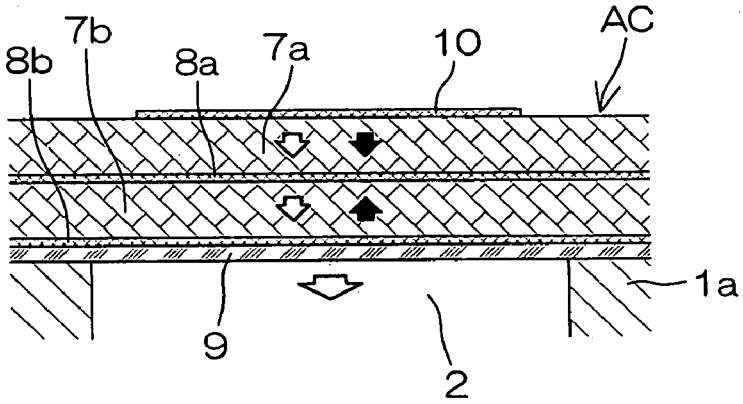
Figure 4C:
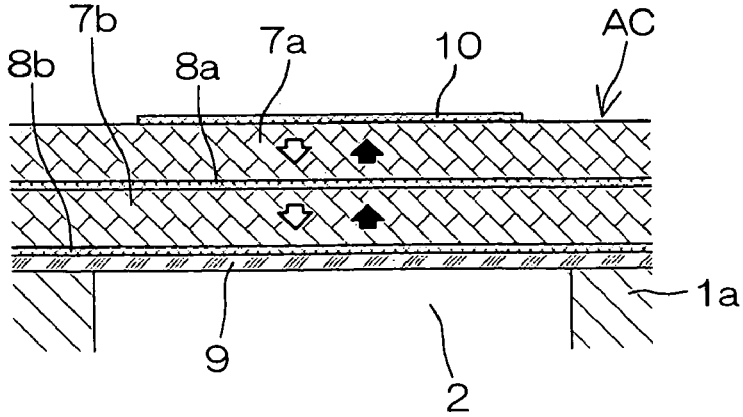

When forming a dot, an electric field of a predetermined potential difference ($V_3$ in FIG. 5C) of opposite sense to the polarizing direction of the layer 7*b* is applied to the second piezoelectric ceramic layer 7*b* with a predetermined pulse width $W_1$ by using the first and second common electrodes 8*a*, 8*b* as indicated by black arrow mark shown in the second piezoelectric ceramic layer 7*b* in FIG. 4B and FIG. 4C.

At the same time for the pressure chamber 2 mentioned in (1), using the individual electrode 10 and the first common electrode 8*a*, an electric field of a predetermined potential difference ($V_1$ in FIG. 5A) of the same sense as the polarizing direction of the layer 7*a* is applied with the same pulse width $W_1$ to a region of the first piezoelectric ceramic layer 7*a* disposed between the individual electrode 10 and the first common electrode 8*a* by using these electrodes as indicated by black arrow mark shown in the first piezoelectric ceramic layer 7*a* in FIG. 4B.

Then the first piezoelectric ceramic layers 7*a* contracts in the direction of the surface and the second piezoelectric ceramic layers 7*b* expands in the direction of the surface, so that satisfactory deflection of the corresponding region of the piezoelectric actuator AC can be achieved toward the direction indicated by large white arrow mark in the pressure chamber 2 with a lower voltage than used in the conventional unimorph type by the function of bimorph type.

At the same time, in the pressure chamber 2 mentioned in (2), an electric field of a predetermined potential difference ($V_2$ in FIG. 5B) of opposite sense to the above is applied to a region of the layer 7*a* disposed between the electrodes 10, 8*a* with the same pulse width $W_1$ by using the individual electrode 10 and the first common electrodes 8*a* as indicated by black arrow mark shown in the first piezoelectric ceramic layer 7*a* in FIG. 4C.

Then the region of the first piezoelectric ceramic layer 7*a* is caused to expand together with the second piezoelectric ceramic layer 7*b* in the direction of surface, so that the region of the piezoelectric actuator AC can be maintained in the same state as the initial state.

Thus an ink droplet is discharged through the nozzle 3 by selectively deflecting the region of the piezoelectric actuator AC that corresponds to the pressure chamber 2 described in (1), thereby forming a dot.

After applying the electric field with the predetermined pulse width $W_1$, the standby state is resumed (after $T_2$ in FIG. 5A through FIG. 5C).

In order to form dots successively, electric field may be applied repetitively with the pulse width $W_1$ at predetermined intervals.

While there is no imitation to the intensity of the electric field applied to the piezoelectric ceramic layers 7*a*, 7*b*, it is preferable to set the potential differences $V_2$, $V_3$ to about one half the potential differences $V_1$, in case the piezoelectric ceramic layers 7*a*, 7*b* are made of exactly the same piezoelectric material with the same thickness. This enables more satisfactory deflection of the corresponding region of the piezoelectric actuator AC for the pressure chamber 2 mentioned in (1). At the same time, the corresponding region of the piezoelectric actuator AC can be maintained in the same state as the initial state for the pressure chamber 2 mentioned in (2).

Now the process of discharging the ink through the nozzle 3 that communicates with the pressure chamber 2 mentioned in (1) will be described, with reference to FIG. 6 that shows the relation between the pulse waveform of the electric field (shown in FIG. 5A) applied to the first piezoelectric ceramic layer 7*a* in the first drive method described above and the change in the volumetric velocity of the ink in the nozzle 3 when the pulse waveform is given.

Figure 6:
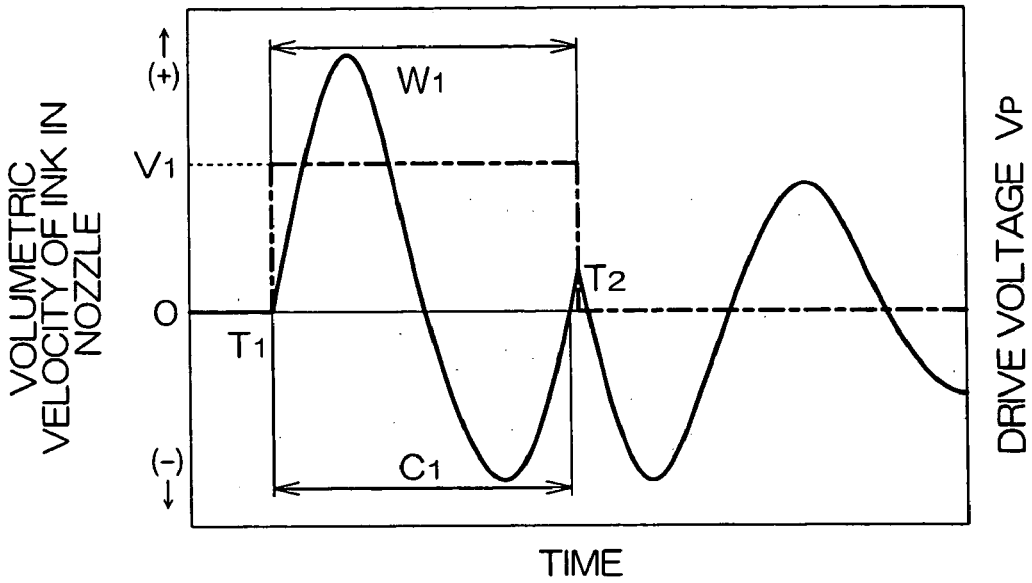
FIG. 6 is a graph schematically showing the relation between the pulse waveform of the electric field applied to the first piezoelectric ceramic layer in the first drive method described above and the change in the volumetric velocity of the ink in the nozzle when the pulse waveform is given.

During the standby period to the left of $T_1$ in FIG. 6, since electric field $V_p$ is not applied to the first piezoelectric ceramic layer 7*a* ($V_p$=0), and electric field is not applied also to the second piezoelectric ceramic layer 7*b*, although not shown in the drawing, volumetric velocity of the ink in the nozzle 3 is maintained at 0 with the capacity of the pressure chamber 2 remaining in the initial value.

When an ink droplet is discharged through the nozzle 3 so as to form a dot on paper, electric field of $V_p$=$V_1$ is applied to the first piezoelectric ceramic layer 7*a* at a time $T_1$ immediately before discharging, and electric field of $V_3$ is applied to second piezoelectric ceramic layer 7*b* so that the corresponding region of the piezoelectric actuator AC deflects so as to protrude into the pressure chamber 2, as described previously, then the ink in the nozzle 3 is pushed outward and ink meniscus protrudes out of the nozzle 3 by the amount corresponding to the amount of decrease in the capacity of the pressure chamber 2 that is caused by the deflection. Volumetric velocity of the ink in the nozzle 3 at this time increases toward (+) as shown and reaches a peak in the period from $T_1$ to $T_2$ in FIG. 6, then turns to decrease toward (−) and reaches a trough, then turns to increase again to approach 0. This cycle corresponds to the intrinsic vibration period $C_1$ of the volumetric velocity of ink indicated by thick solid line.

Movement of ink up to this point will be described in more detail below. The ink in the nozzle 3 is first pushed out of the nozzle 3 by the first deflection of the piezoelectric actuator AC. Then as the volumetric velocity of ink in the nozzle 3 increases toward (−) due to the intrinsic vibration of the ink, a force of pulling the ink into the nozzle is applied to the ink that has been pushed out of the nozzle 3. However, since the distal end of the ink that has been pushed out of the nozzle 3 remains moving toward the outside, the distal end portion is elongated in the direction of pushing so as to form an ink column.

Then, at time $T_2$ when the volumetric velocity of ink in the nozzle 3 becomes 0 or past 0, application of the electric field to the first piezoelectric ceramic layer 7*a* is stopped ($V_p$=0), and application of the electric field to the second piezoelectric ceramic layer 7*b* is also stopped, so that deflection of the piezoelectric actuator AC is canceled. These operations are equivalent to applying to the first piezoelectric ceramic layer 7*a* an electric field of pulse waveform of FIG. 5A that has pulse width $W_1$ approximately equal to the intrinsic vibration period $C_1$, as indicated by the thick dot-and-dash line, and applying to the second piezoelectric ceramic layer 7*b* an electric field having pulse waveform of FIG. 5C that has the same pulse width $W_1$.

While the ink meniscus in the nozzle 3 is located at a position retracted to the extreme toward the pressure chamber 2 at the time when the volumetric velocity of ink in the nozzle 3 is zero, then the ink is urged toward the outside of the nozzle 3 by the intrinsic vibration of the ink. That is, at time $T_2$, the ink meniscus in the nozzle 3 is in the course of moving from the position retracted to the extreme toward the pressure chamber 2 to the outside of the nozzle 3.

Therefore, when the ink is caused to undergo vibration of opposite phase by canceling the deflection of the piezoelectric actuator AC and increasing the capacity of the pressure chamber 2 at time $T_2$, the ink column is separated so as to form an ink droplet. As the ink droplet thus formed reaches the paper surface, a dot is formed on the paper.

When the mechanism of discharging an ink droplet is taken into consideration, pulse width $W_1$ is preferably approximately equal to the intrinsic vibration period $C_1$ of the volumetric velocity of ink in the nozzle 3. While specific range is not defined, it is preferable that pulse width $W_1$ is set in a range from 1 to 5/4 times the intrinsic vibration period $C_1$. Within this range, efficiency of discharging the ink can be improved since more ink can be separated from the ink meniscus in the nozzle 3 and discharged as an ink droplet by the mechanism described above.

<Method II for Driving the Piezoelectric Ink Jet Head>

The second drive method of the present invention for driving the piezoelectric ink jet head to form a dot will be described below with reference to FIG. 7A through FIG. 7E and FIG. 8A through FIG. 8C.

Figure 8A:
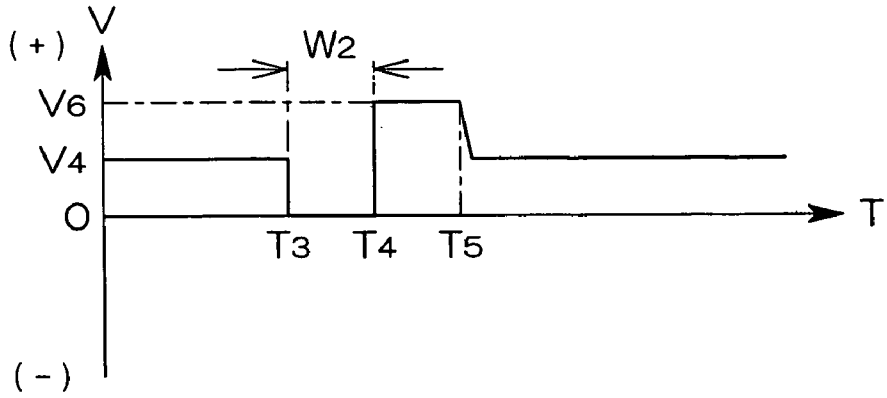
FIG. 8A through FIG. 8C are graphs showing the pulse waveform of the electric field applied to both piezoelectric ceramic layers in the drive method described above.
Figure 8B:
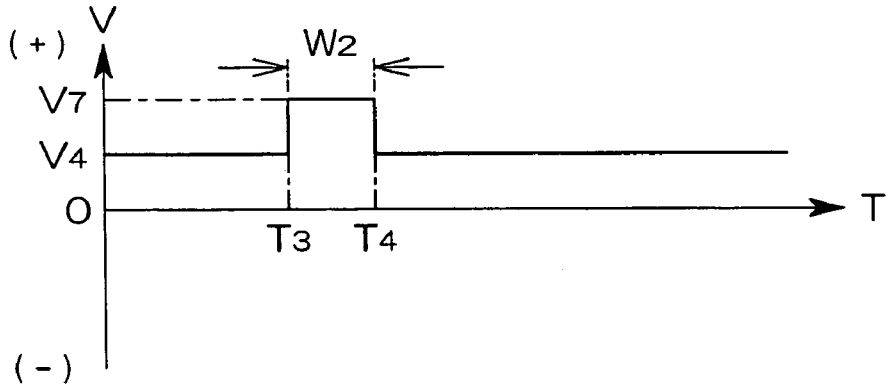
Figure 8C:
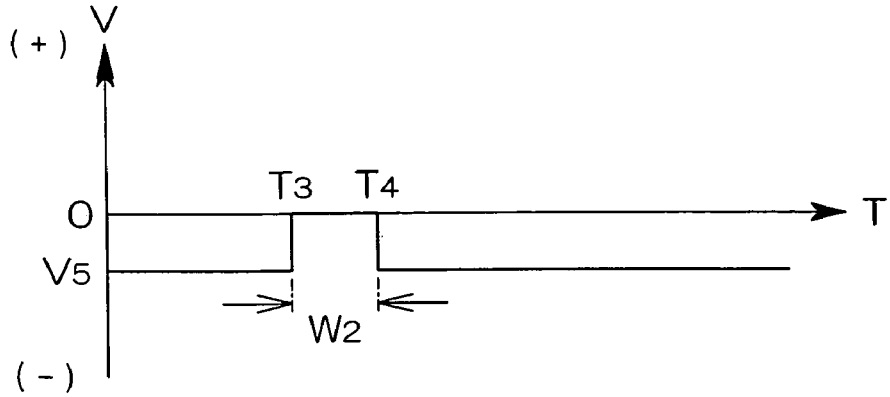

FIG. 8A through FIG. 8C are graphs showing an example of pulse waveform of the electric field applied to the piezoelectric ceramic layers 7*a*, 7*b* in the second drive method.

FIG. 8A shows the pulse waveform of electric field applied to a region of the first piezoelectric ceramic layer 7*a* disposed between the individual electrode 10 that corresponds to the pressure chamber 2 and the first common electrode 8*a* by using both electrodes for the pressure chamber 2 mentioned in (i) from which an ink droplet should be discharged through the nozzle 3. FIG. 8B shows the pulse waveform of electric field applied to the region of the first piezoelectric ceramic layer 7*a* for the pressure chamber 2 mentioned in (ii) from which an ink droplet should not be discharged. FIG. 8C shows the pulse waveform of electric field applied to the second piezoelectric ceramic layer 7*b* by using the first and second common electrodes 8*a*, 8*b*.

In these figures, the same sense of electric field as the direction of polarization of the piezoelectric ceramic layers 7*a*, 7*b* is denoted as (+) and opposite sense of electric field is denoted as (−). The common electrode 8*a* is grounded.

Figure 7A:
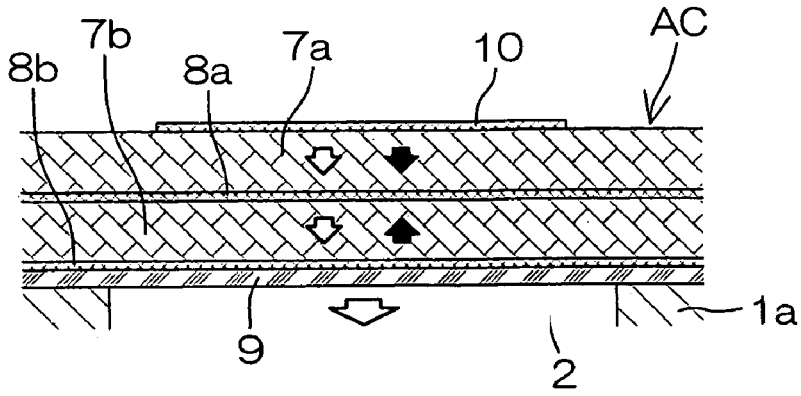
FIG. 7A through FIG. 7E are sectional views explanatory of the relation between the sense of electric field applied to the first and second piezoelectric ceramic layers and the polarizing direction of both piezoelectric ceramic layers when driving the piezoelectric ink jet head of the example described above by the second drive method of the present invention.

With the drive method described above, during the standby period prior to time $T_3$ in FIG. 8A through FIG. 8C, electric field of a predetermined potential difference ($V_4$ in FIG. 8A and FIG. 8B) of the same sense as the direction of polarization of the layer 7*a* (indicated by white arrow mark in the layer 7*a* in the figure) is applied to the entire region of the first piezoelectric ceramic layer 7*a* disposed between the electrodes 10, 8*a* as indicated by black arrow mark in the first piezoelectric ceramic layer 7*a* in FIG. 7A by using all of the individual electrodes 10 and the first common electrode 8*a*.

At the same time, electric field of a predetermined potential difference ($V_5$ in FIG. 8C) of the opposite sense to the direction of polarization of the layer 7*b* (indicated by white arrow mark in the layer 7*b* in the figure) is applied to the second piezoelectric ceramic layer 7*b* as indicated by black arrow mark in the first piezoelectric ceramic layer 7*b* in FIG. 7A by using the first and second common electrodes 8*a*, 8*b*.

Potential differences $V_4$, $V_5$ of the electric fields have substantially the same intensity.

Then the region of the first piezoelectric ceramic layers 7*a* disposed between all the individual electrodes 10 and the first common electrode 8*a* contracts in the direction of surface and the second piezoelectric ceramic layers 7*b* expands in the direction of surface, so that the state of satisfactory deflection of the region of the piezoelectric actuator AC protruding in the direction indicated by the large white arrow mark in the pressure chamber 2 can be maintained with a lower voltage than used in the conventional unimorph type by the function of bimorph type, described previously.

In this state, the ink supplied from the ink cartridge fills the piping of the ink cartridge, the through hole 11, the common feed passage 6, the feed port 5, the pressure chamber 2 and the nozzle passage 4, and is stationary in the state of forming ink meniscus in the nozzle 3.

When forming a dot, at the time $T_3$, the electric field applied to the second piezoelectric ceramic layer 7*b* by using the first and second common electrodes 8*a*, 8*b* is once removed (potential difference 0 V) so as to cancel the expansion of the layer 7*b* in the direction of surface, and then at time $T_4$ immediately thereafter, an electric field of the same predetermined potential difference $V_5$ as that during the standby period is applied so as to expand the layer 7*b* by the same amount in the direction of surface.

Figure 7B:
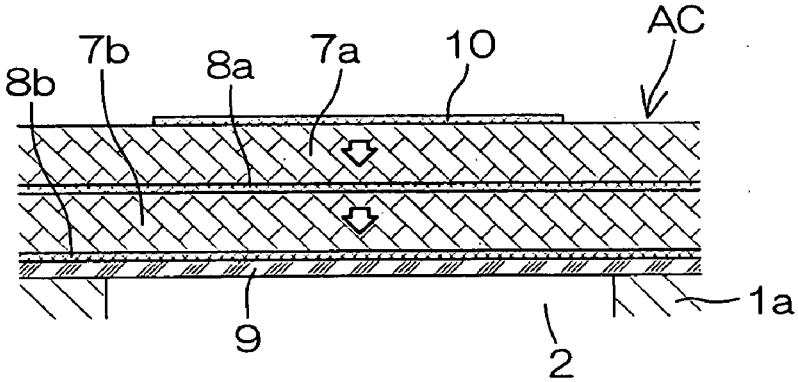

For the pressure chamber 2 mentioned in (i), in synchronization with the operation described above, the electric field applied to the region of the first piezoelectric ceramic layer 7*a* disposed between the electrodes 10, 8*a* by using the individual electrode 10 that corresponds to the pressure chamber 2 and the first common electrode 8*a* is also removed (potential difference 0 V) so as to cancel the contract of the region in the direction of plane at time $T_3$ (FIG. 7B).

This puts the corresponding region of the piezoelectric actuator AC in the initial state, so that the ink meniscus in the nozzle 3 can be pulled in toward the pressure chamber 2.

Figure 7C:
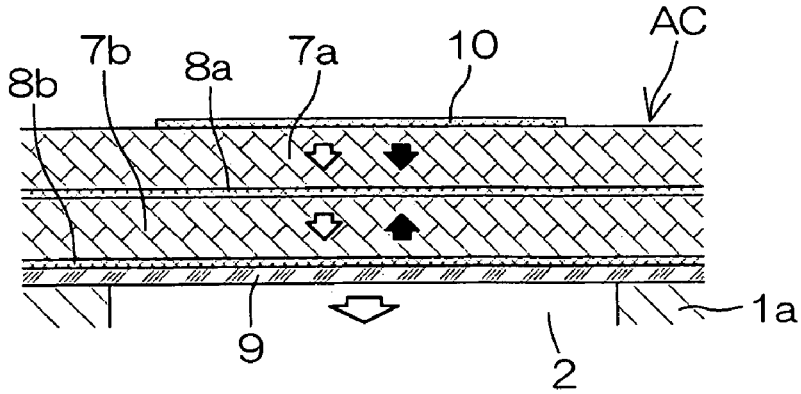

Then at the time $T_4$, an electric field of a predetermined potential difference ($V_6$ in FIG. 8A) of the same sense as the polarizing direction of the layer 7*a* is applied to the region of the layer 7*a* disposed between the electrodes 10, 8*a* by using the individual electrode 10 and the first common electrode 8*a* as indicated by black arrow mark shown in the first piezoelectric ceramic layer 7*a* in FIG. 7C.

Potential difference $V_6$ is set at to about twice the potential difference $V_4$ applied during standby, thereby causing the region of the first piezoelectric ceramic layer 7*a* disposed between the electrodes 10, 8*a* to contract more than during the standby period in the direction of plane, so that the region of the piezoelectric actuator AC is caused to deflect and protrude more than during the standby period in the direction indicated by the large white arrow mark in the pressure chamber 2 by the function of bimorph function in line with the expansion of the second piezoelectric ceramic layer 7*b* in the direction of plane, thereby discharging the ink in the form of column from the nozzle 3.

Immediately thereafter, at time $T_5$ in FIG. 8A, the electric field applied between the electrodes 10, 8*a* is decreased to $V_4$ again, thereby changing the amount of contraction of the region of the first piezoelectric ceramic layer 7*a* disposed between the electrodes 10, 8*a* to that of standby period and returning the corresponding region of the piezoelectric actuator AC to the standby state, so that the ink is pulled back into the pressure chamber 2 and the ink column is separated so as to generate an ink droplet.

Figure 7D:
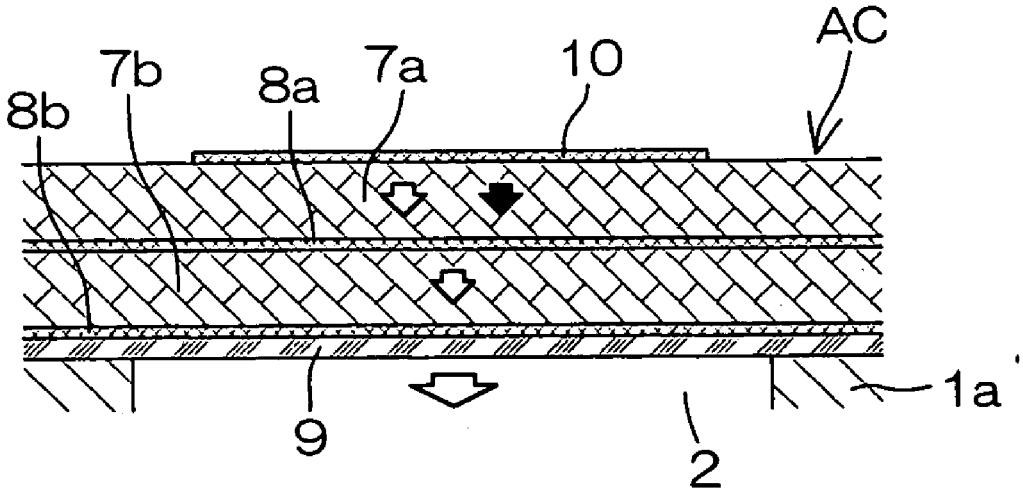

For the pressure chamber 2 mentioned in (ii), at the time $T_3$, an electric field of a predetermined potential difference ($V_7$ in FIG. 8B) of the same sense as the polarizing direction of the layer 7*a* is applied to the region of the layer 7*a* disposed between the electrodes 10, 8*a* by using the individual electrode 10 and the first common electrode 8*a* as indicated by black arrow mark shown in the first piezoelectric ceramic layer 7*a* in FIG. 7D.

Potential difference $V_7$ is set to about twice the potential difference $V_4$ applied during standby, thereby causing the region of the first piezoelectric ceramic layer 7*a* disposed between the electrodes 10, 8*a* to contract more than during the standby period in the direction of surface, so that the amount of deflection of the corresponding region of the piezoelectric actuator AC in the direction indicated by the large white arrow mark in the pressure chamber 2 can be maintained at a similar level to that of the standby period by compensating for the cancellation of the expansion of the second piezoelectric ceramic layer 7*b* in the direction of surface.

Then at the time $T_4$, potential difference of the electric field applied to the region of the layer 7*a* disposed between the electrodes 10, 8*a* is decreased to $V_4$ again in synchronization with the application of electric field to the second piezoelectric ceramic layer 7*b* to expand again in the direction of plane (FIG. 8B).

Figure 7E:
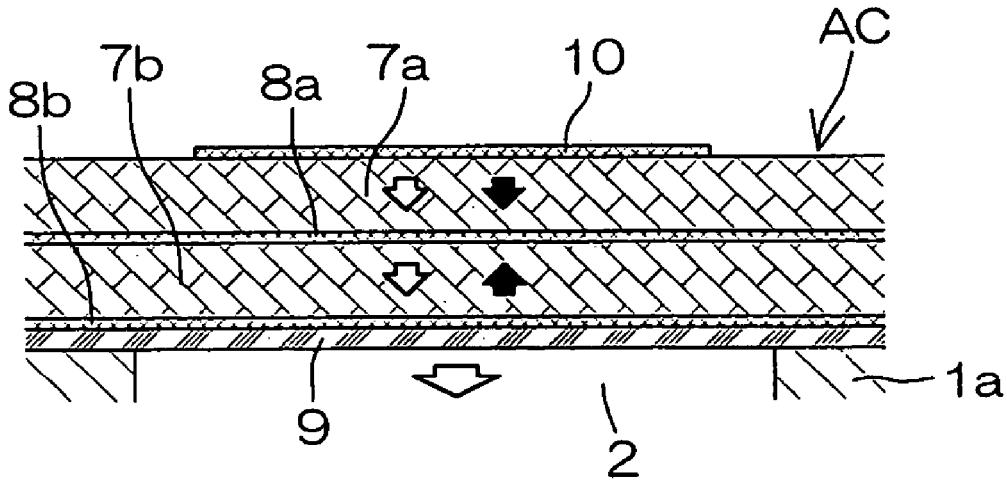

This makes it possible to change the amount of contraction of the region of the first piezoelectric ceramic layer 7*a* disposed between the electrodes 10, 8*a* to that of standby period and returning the corresponding region of the piezoelectric actuator AC to the standby state by the function of bimorph type in line with the expansion of the second piezoelectric ceramic layer 7*b* in the direction of surface (FIG. 7E).

This enables it to maintain the stationary state of the ink meniscus in the nozzle 3 and prevent ink droplet from being discharged for the pressure chamber 2 mentioned in (ii).

Thus it is made possible to discharge an ink droplet selectively from the nozzle 3 that communicates with the pressure chamber 2 mentioned in (i) so as to form a dot.

In order to form dots successively, the series of applications of the electric field may be carried out repetitively at predetermined intervals.

Now the process of discharging the ink through the nozzle 3 communicating with the pressure chamber 2 mentioned in (i) so as to form the dot by the drive method will be described, with reference to FIG. 9 that shows the relation between the pulse waveform of the electric field (shown in FIG. 8A) applied to the first piezoelectric ceramic layer 7*a* and the change in the volumetric velocity of the ink in the nozzle 3.

Figure 9:
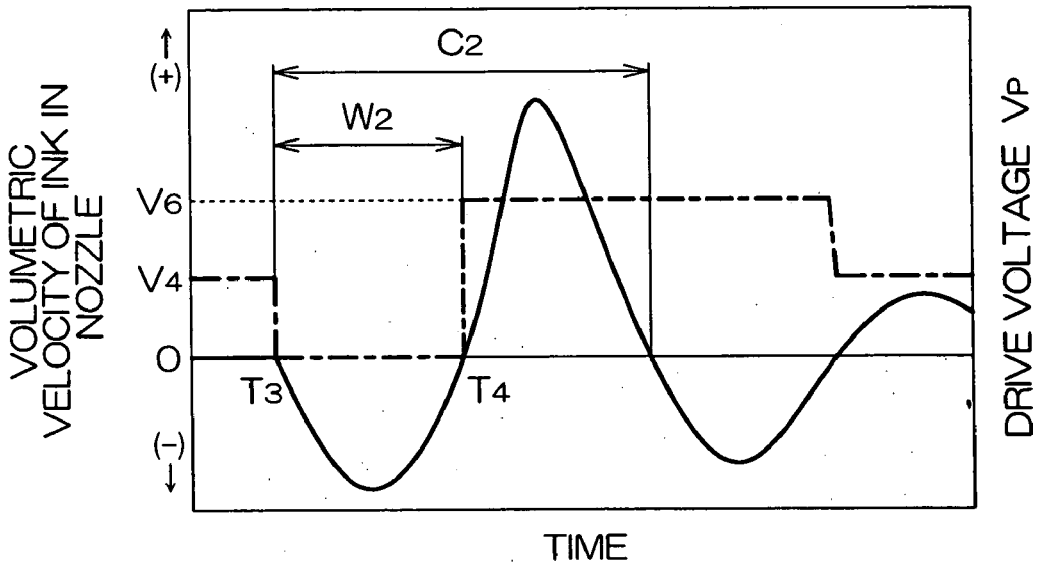
FIG. 9 is a graph schematically showing the relation between the pulse waveform of the electric field applied to the first piezoelectric ceramic layer in the second drive method described above and the change in the volumetric velocity of the ink in the nozzle when the pulse waveform is given.
Figure 10:
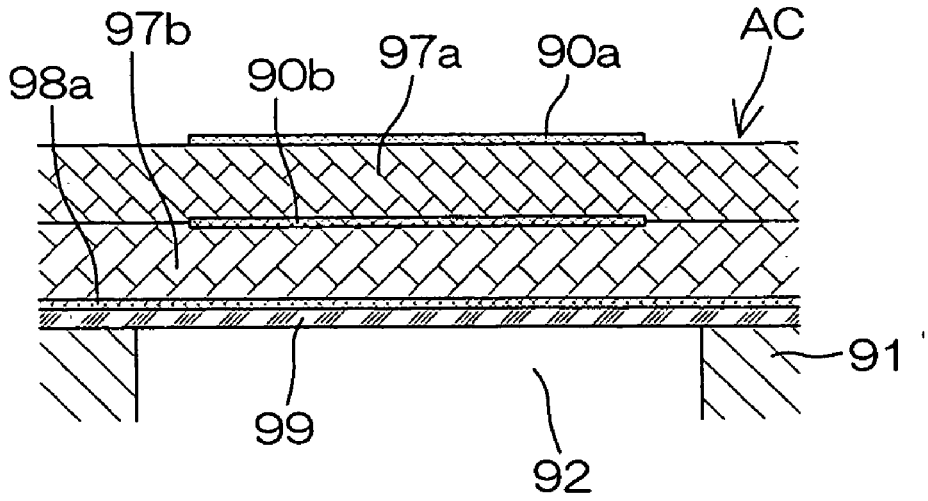
FIG. 10 and FIG. 11 are sectional views showing the constitution of the electrodes in bimorph piezoelectric ink jet head of the prior art.
Figure 11:
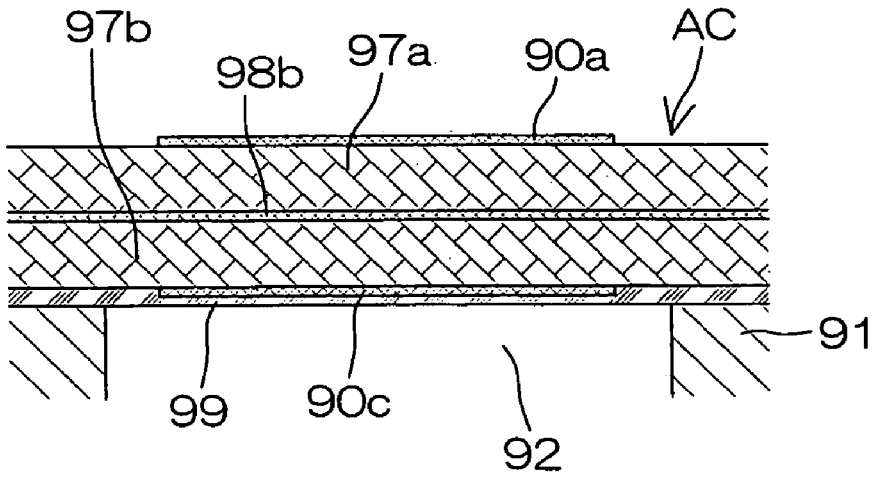

During the standby period to the left of $T_3$ in FIG. 9, since electric field $V_p=V_4$ is applied continuously to the first piezoelectric ceramic layer 7*a*, electric field $V_5$ is applied continuously to the second piezoelectric ceramic layer 7*b*, although not shown in the drawing, so as to keep the piezoelectric actuator AC deflected in a predetermined shape and capacity of the pressure chamber 2 is kept at a state of decreased by a certain amount, the ink in the head is kept in stationary state, namely volumetric velocity of the ink in the nozzle 3 is maintained at 0.

When an ink droplet is discharged through the nozzle 3 so as to form a dot on paper, application of the electric field to the first piezoelectric ceramic layer 7*a* is stopped ($V_p=0$) at a time $T_3$ immediately before discharging, and the application of the electric field to the second piezoelectric ceramic layer 7*b* is also stopped so that the deflection of the piezoelectric actuator AC is canceled. Then as the capacity of the pressure chamber 2 increases by a certain amount, the ink in the nozzle 3 is pulled toward the pressure chamber 2 by the corresponding amount. At this time, volumetric velocity of the ink in the nozzle 3 increases toward (−) in the period from $T_3$ to $T_4$ in FIG. 9, then approaches 0. This cycle corresponds to about one half of the intrinsic vibration period $C_2$ of the volumetric velocity of ink indicated by thick solid line.

Then at time $T_4$ when the volumetric velocity of ink in the nozzle has approached 0, electric field $V_p=V_6$ is applied to the first piezoelectric ceramic layer 7*a* and electric field of $V_5$ is applied again to the second piezoelectric ceramic layer 7*b*, so that the piezoelectric actuator AC deflects. These operations are equivalent to applying to the first piezoelectric ceramic layer 7*a* an electric field of pulse waveform of FIG. 8A that has pulse width $W_2$ approximately equal to one half of the intrinsic vibration period $C_2$, as indicated by the thick dot-and-dash line, and applying to the second piezoelectric ceramic layer 7*b* an electric field having pulse waveform of FIG. 8C that has the same pulse width $W_2$.

With the application of this electric field, the ink in the nozzle 3 that is about to return from the stationary state in which the ink meniscus is pulled toward the pressure chamber 2 to the extreme (volumetric velocity 0 at time $T_4$) toward (+) is subjected to the pressure of ink pushed out of the pressure chamber 2 due to the decrease in capacity of the pressure chamber 2 caused by the deflection of the piezoelectric actuator AC. This causes the ink to protrude from the tip of the nozzle 3 significantly toward (+) so as to form an ink column. When the ink column has elongated to the limit, the ink column separates as an ink droplet and flies to reach the paper, thus forming a dot on the paper.

When the mechanism of discharging ink droplet is taken into consideration, pulse width $W_2$ is preferably approximately one half of the intrinsic vibration period $C_2$ of the volumetric velocity of ink in the nozzle 3. While specific range is not defined, it is preferable that pulse width $W_2$ is set in a range from ½ to ¾ times the intrinsic vibration period $C_2$. Within this range, efficiency of discharging the ink can be improved since more ink can be separated from the ink meniscus in the nozzle 3 and discharged as an ink droplet by the mechanism described above.

Of the pulse waveform shown in FIG. 8A, timing $T_5$ of decreasing the intensity of electric field applied between the electrodes 10, 8*a* from $V_6$ to $V_4$ preferably corresponds to the time when the ink meniscus in the nozzle continues vibration and turns from moving toward (−) to moving toward (+) after discharging the ink droplet as shown in FIG. 9. This enables it to suppress subsequent vibration of the ink meniscus.

EXAMPLES

Now the present invention will be described by way of examples.

Fabrication of Piezoelectric Ink Jet Head

A piezoelectric ink jet head having the structure shown in FIG. 1 through FIG. 3 was fabricated with the pressure chamber 2 having area of 0.2 $mm^2$ and measuring 200 μm in width and 100 μm in depth, the nozzle 3 measuring 25 μm in diameter and 30 μm in length, the nozzle passage 4 measuring 200 μm in diameter and 800 μm in length, the feed port 5 measuring 25 μm in diameter and 30 μm in length, the first piezoelectric ceramic layer 7*a* measuring 20 μm in thickness, and the second piezoelectric ceramic layer 7*b* measuring 20 μm in thickness.

An electric field of potential difference $V_1$=20 V having the waveform shown in FIG. 5A was applied to the region of the first piezoelectric ceramic layer 7*a* disposed between the individual electrode 10 that corresponds to one pressure chamber 2 and the first common electrode 8*a* by using the electrodes and, at the same time, an electric field of potential difference $V_3$=10 V having the waveform shown in FIG. 5C was applied to the second piezoelectric ceramic layer 7*b* by using the first and second common electrode 8*a*, 8*b*, thereby causing the piezoelectric actuator AC of the piezoelectric ink jet head made as described above to deflect. Measurement with a laser Doppler vibration meter showed that the displacement of the individual electrode 10 at the center thereof was 0.10 μm.

For the purpose of comparison, the piezoelectric actuator AC was caused to deflect by applying electric field of potential difference $V_1$=20 V only to the region of the first piezoelectric ceramic layer 7*a* described above without applying electric field to the second piezoelectric ceramic layer 7*b*, and measure the deflection that was 0.07 μm.

From these results, it was verified that deflection of about 1.5 times the unimorph type can be achieved with the bimorph type.

With the common feed passage 6, the feed port 5, the pressure chamber 2, the nozzle passage 4 and the nozzle 3 of the piezoelectric ink jet head made as described above filled with the ink, an electric field having the waveform shown in FIG. 8A was applied to the region of the first piezoelectric ceramic layer 7*a* disposed between the individual electrode 10 that corresponds to one pressure chamber 2 and the first common electrode 8*a* by using the electrodes and, at the same time, an electric field having the waveform shown in FIG. 8C was applied to the second piezoelectric ceramic layer 7*b* by using the first and second common electrode 8*a*, 8*b*, thereby discharging an ink droplet from the nozzle 3. Velocity of the droplet was about 8 m/s. Intensities of the electric fields were $V_4=V_5$=10 V and $V_6$=20 V.

For the purpose of comparison, ink droplet was discharged from the nozzle 3 by applying electric field having the same waveform only to the region of the first piezoelectric ceramic layer 7*a* described above without applying electric field to the second piezoelectric ceramic layer 7*b*, and the velocity was about 4 m/s.

From these results, it was verified that discharge performance of about 2 times the unimorph type can be achieved with the bimorph type.

The present application is in correspondence to patent application Ser. No.2003-187956 filed with Japanese Patent Office on Jun. 30, 2003, and the whole disclosure thereof is incorporated herein by reference.

The invention claimed is:

1. A method for driving a piezoelectric ink jet head that comprises a plate-shaped substrate having a plurality of recesses that would become pressure chambers to be filled with an ink being formed on one side of the substrate in the direction of substrate surface, with a nozzle that discharges the ink filling the pressure chamber as ink droplet to communicate with each recess, and a piezoelectric actuator having a first piezoelectric ceramic layer of transverse vibration mode, a first common electrode, a second piezoelectric ceramic layer of transverse vibration mode and a second common electrode, all having such a size that covers the plurality of pressure chambers, are stacked in this order from a position far from the substrate on the surface of the substrate where the recesses are formed, and having a plurality of individual electrodes formed thereon in correspondence to the pressure chambers is disposed on the first piezoelectric ceramic layer, characterized that the piezoelectric actuator is put in the initial state by removing the electric fields applied to both of the piezoelectric ceramic layers in the period of standby, while an electric field of opposite sense to the polarizing direction is applied to the second piezoelectric ceramic layer by using the first and second common electrodes when forming a dot, and in synchronization thereof, (1) for the pressure chambers from which ink droplet should be discharged through the nozzle, an electric field of the same sense to the polarizing direction of the layer is applied to a region of the first piezoelectric ceramic layer disposed between the individual electrode corresponding to the pressure chamber and the first common electrode by using the electrodes, thereby causing the corresponding region of the piezoelectric actuator to deflect and protrude toward the pressure chamber, while (2) for the pressure chambers from which ink droplet should not be discharged through the nozzle, an electric field of the opposite sense to the polarizing direction of the layer is applied to a region of the first piezoelectric ceramic layer disposed between the individual electrode corresponding to the pressure chamber and the first common electrode by using the electrodes, thereby maintaining the corresponding region of the piezoelectric actuator in the initial state, so as to discharge an ink droplet selectively through the nozzle that communicates with the pressure chamber described in (1) and form a dot.

2. The method for driving the piezoelectric ink jet head according to claim 1, wherein the first and second piezoelectric ceramic layers are made of the same piezoelectric material with the same thickness and, when forming a dot, potential difference $V_1$ of electric field that is applied to a region of the first piezoelectric ceramic layer disposed between the individual electrode corresponding to the pressure chamber from which the ink should be discharged through the nozzle and the first common electrode by using the electrodes, potential difference $V_2$ of electric field that is applied to a region of the first piezoelectric ceramic layer disposed between the individual electrode corresponding to the pressure chamber from which the ink should not be discharged through the nozzle and the first common electrode by using the electrodes, and potential difference $V_3$ of electric field applied to the second piezoelectric ceramic layer are set to satisfy the equation $\frac{1}{2}V_1=V_2=V_3$.

3. The method for driving the piezoelectric ink jet head according to claim 1, wherein pulse width from the start of applying the electric field to the removal thereof is set in a range from 1 to 5/4 times the intrinsic period of vibration of the volumetric velocity of the ink in the nozzle, for the electric field of the opposite sense to the polarizing direction applied to the second piezoelectric ceramic layer when forming a dot, the electric field of the same sense as the polarizing direction applied to the region of the first piezoelectric ceramic layer that corresponds to the pressure chamber from which the ink should be discharged through the nozzle in synchronization with the electric field mentioned above, and the electric field of the opposite sense to the polarizing direction of the layer applied to the region of the first piezoelectric ceramic layer from which the ink should not be discharged through the nozzle in synchronization with the electric fields mentioned above.

4. A method for driving a piezoelectric ink jet head that comprises a plate-shaped substrate having a plurality of recesses that would become pressure chambers to be filled with an ink being formed on one side of the substrate in the direction of substrate surface, with a nozzle that discharges the ink filling the pressure chamber as ink droplet to communicate with each recess, and a piezoelectric actuator having a first piezoelectric ceramic layer of transverse vibration mode, a first common electrode, a second piezoelectric ceramic layer of transverse vibration mode and a second common electrode, all having such a size that covers the plurality of pressure chambers, are stacked in this order from a position far from the substrate on the surface of the substrate where the recesses are formed, and having a plurality of individual electrodes formed thereon in correspondence to the pressure chambers is disposed on the first piezoelectric ceramic layer, characterized that in the standby period, an electric field of the same sense as the polarizing direction of the layer is applied to the entire region of the first piezoelectric ceramic layer disposed between all of the individual electrodes and the first common electrode by using the electrodes, and an electric field of the opposite sense to the polarizing direction of the layer having substantially the same intensity as that applied to the first piezoelectric ceramic layer is applied to the second piezoelectric ceramic layer by using the first common electrode and the second common electrode, thereby causing the region of the piezoelectric actuator that corresponds to all the pressure chambers to deflect so as to protrude toward the pressure chamber and, when forming a dot, the electric field applied to the second piezoelectric ceramic layer is once removed and, after a predetermined period of time, the same electric field as that of the standby period is applied again and the following processes are carried out so as to discharge an ink droplet selectively through the nozzle that communicates with the pressure chamber described in (i) and form a dot:

(i) for the pressure chamber from which an ink droplet should be discharged through the nozzle, in synchronization with the removal of the electric field applied to the second piezoelectric ceramic layer, the electric field applied to a region of the first piezoelectric ceramic layer disposed between the individual electrode that corresponds to the pressure chamber and the first common electrode by means of the electrodes is also removed so as to put the region of the piezoelectric actuator in the initial state, then in synchronization with the re-application of the electric field to the second piezoelectric ceramic layer, an electric field of the same sense to the polarizing direction of the layer having an intensity about twice that of the standby period is applied to the region of the first piezoelectric ceramic layer so as to cause the region of the piezoelectric actuator to deflect and protrude toward the pressure chamber more than during the standby period and, after a predetermined period of time, intensity of the electric field applied to the region is changed to the level of standby period so as to return the region of the piezoelectric actuator to the standby state, and (ii) for the pressure chamber from which the ink droplet should not be discharged through the nozzle, in synchronization with the removal of the electric field applied to the second piezoelectric ceramic layer, an electric field of the same sense as the polarizing direction of the layer having an intensity about twice that of standby period is applied to a region of the first piezoelectric ceramic layer disposed between the individual electrode that corresponds to the pressure chamber and the first common electrode by means of the electrodes, so as to maintain the amount of deflection of the region of the piezoelectric actuator toward the pressure chamber at the same level as that of the standby period and, thereafter, in synchronization with the re-application of the electric field to the second piezoelectric ceramic layer, intensity of the electric field applied to the region is changed to the level of the standby period so as to return the region of the piezoelectric actuator to the standby state.

5. The method for driving the piezoelectric ink jet head according to claim 4, wherein all the pulse widths are set in a range from ½ to ¾ times the intrinsic period of vibration of the volumetric velocity of the ink in the nozzle, for the pulse width from removal of the electric field applied to the second piezoelectric ceramic layer when forming a dot to the re-application thereof, pulse width from removal of the electric field applied to the region of the first piezoelectric ceramic layer that corresponds to the pressure chamber from which the ink should be discharged through the nozzle in synchronization with the above to the time when the application of an electric field of intensity about twice that of the standby period is started, and pulse width from the time when the electric field of intensity about twice that of the standby period is applied to the region of the first piezoelectric ceramic layer that corresponds to the pressure chamber from which the ink should not be discharged through the nozzle in synchronization with the above to the time when the intensity of the electric field is changed to the level of the standby period.

* * * * *